US005509459A

United States Patent [19]

Divecha et al.

[11] Patent Number: 5,509,459

[45] Date of Patent: Apr. 23, 1996

[54] PRESSURE CAST ALUMINA TILE REINFORCED ALUMINUM ALLOY ARMOR AND PROCESS FOR PRODUCING THE SAME

[75] Inventors: Amarnath P. Divecha, Falls Church; Subhash D. Karmarkar, Great Falls, both of Va.; Scott M. Hoover, Burtonsville; James M. Kerr, Bethesda, both of Md.; William A. Ferrando, Arlington, Va.

[73] Assignee: The United States of America as represented by the Secretary of the Navy, Washington, D.C.

[21] Appl. No.: 313,955

[22] Filed: Sep. 28, 1994

[51] Int. Cl.[6] ..... B22D 19/00

[52] U.S. Cl. ..... 164/98; 164/103; 164/112; 164/333

[58] Field of Search ..... 164/98, 112, 333, 164/334, 103, 332

[56] References Cited

U.S. PATENT DOCUMENTS

| | | | |
|---|---|---|---|
| 537,463 | 4/1895 | Hunter | 164/98 |
| 2,745,437 | 5/1956 | Comstock | 164/332 |
| 3,888,297 | 6/1975 | Davies | 164/112 |
| 4,492,265 | 1/1985 | Donomoto et al. | 164/103 |
| 4,534,266 | 8/1985 | Huet | 164/108 |
| 4,587,707 | 5/1986 | Nishida et al. | 164/112 |
| 4,958,763 | 9/1990 | Divecha et al. | 228/193 |
| 5,337,803 | 8/1994 | Divecha et al. | 164/112 |

FOREIGN PATENT DOCUMENTS

| | | |
|---|---|---|
| 1130864 | 5/1989 | Japan . |
| 835626 | 1/1968 | U.S.S.R. . |

OTHER PUBLICATIONS

"Composite Castings" *Metal Industry,* Jul. 10, 1953, by Schwietzke.

*Primary Examiner*—Richard K. Seidel
*Assistant Examiner*—Randy Herrick
*Attorney, Agent, or Firm*—Charles D. Miller; Gary G. Borda

[57] ABSTRACT

A process for forming pressure cast alumina tile reinforced aluminum alloy armor in which a silver coated aluminum disc is first inserted into a mold assembly, the mold assembly includes a base plate, a hollow steel die with a removable steel liner located on the base plate, a plug disposed on the base plate within the die cavity, and a punch movably disposed within the die cavity, the aluminum disc being inserted within the die cavity over the plug. Next, an alumina tile preform is prepared by cutting a plurality of alumina tiles and weaving the tiles together with a stiff steel wire. The alumina tile preform is inserted over the silver coated aluminum disc in the cavity of mold assembly. The steel die, the plug and the disc are heated. The punch is also heated separately. A melt of molten aluminum is prepared and poured into the die cavity, completely covering the alumina tile preform. The heated punch is immediately driven into the cavity to apply pressure to the molten aluminum. When the mold assembly cools, the punch is retracted, the base plate is removed, and the composite billet of pressure cast alumina tile reinforced aluminum alloy armor is removed from the mold.

9 Claims, 2 Drawing Sheets

PRESSURE CAST ALUMINA TILE REINFORCED ALUMINUM ALLOY ARMOR AND PROCESS FOR PRODUCING THE SAME

This invention was made with Government support by the Naval Surface Warfare Center. The Government has certain rights in this invention.

BACKGROUND OF THE INVENTION

1. Field of the Invention

The present invention relates to pressure cast alumina tile reinforced aluminum based armor, and more particularly to a process for producing such armor.

2. Description of the Related Art

Presently, alumina tile reinforced aluminum armor is prepared by a very slow and expensive method. First, the alumina tiles are precisely cut to size. Next, a numerically controlled machine is used to machine an aluminum block to the tile configuration, using the cut tiles as templates. Next, the tiles are placed accurately at their respective positions within the aluminum block. The aluminum block is then closed, welded shut and machined to the final armor size. This procedure is labor intensive, time consuming, and therefore expensive.

SUMMARY OF THE INVENTION

The present invention overcomes the deficiencies of the prior art by providing an inexpensive tile reinforced armor and an economical process of fabricating the same.

The process of forming a billet of pressure cast alumina tile reinforced aluminum alloy armor according to the present invention comprises the steps of inserting a disc into a mold assembly, the mold assembly including a base plate, a die with an inner cavity disposed on the base plate, a plug disposed on the base plate within the die cavity, and a punch movably disposed within the die cavity. The disc is inserted in the mold assembly over the plug.

A tile preform is inserted over the disc in the mold assembly. The mold assembly and the tile preform contained therein are then heated to a first predetermined temperature. The punch is separately heated to a second predetermined temperature.

A predetermined quantity of molten aluminum is prepared and poured into the mold assembly to cover the tile preform. The heated punch is then driven immediately into the die cavity to apply pressure to the molten aluminum while the molten aluminum cools and solidifies, forming a billet of tile reinforced aluminum armor within the mold assembly. Finally, the billet is removed from the mold assembly.

Other features and advantages of the present invention will become apparent from the following description of the invention which refers to the accompanying drawings.

DETAILED DESCRIPTION OF THE PREFERRED EMBODIMENTS

Figure 1:
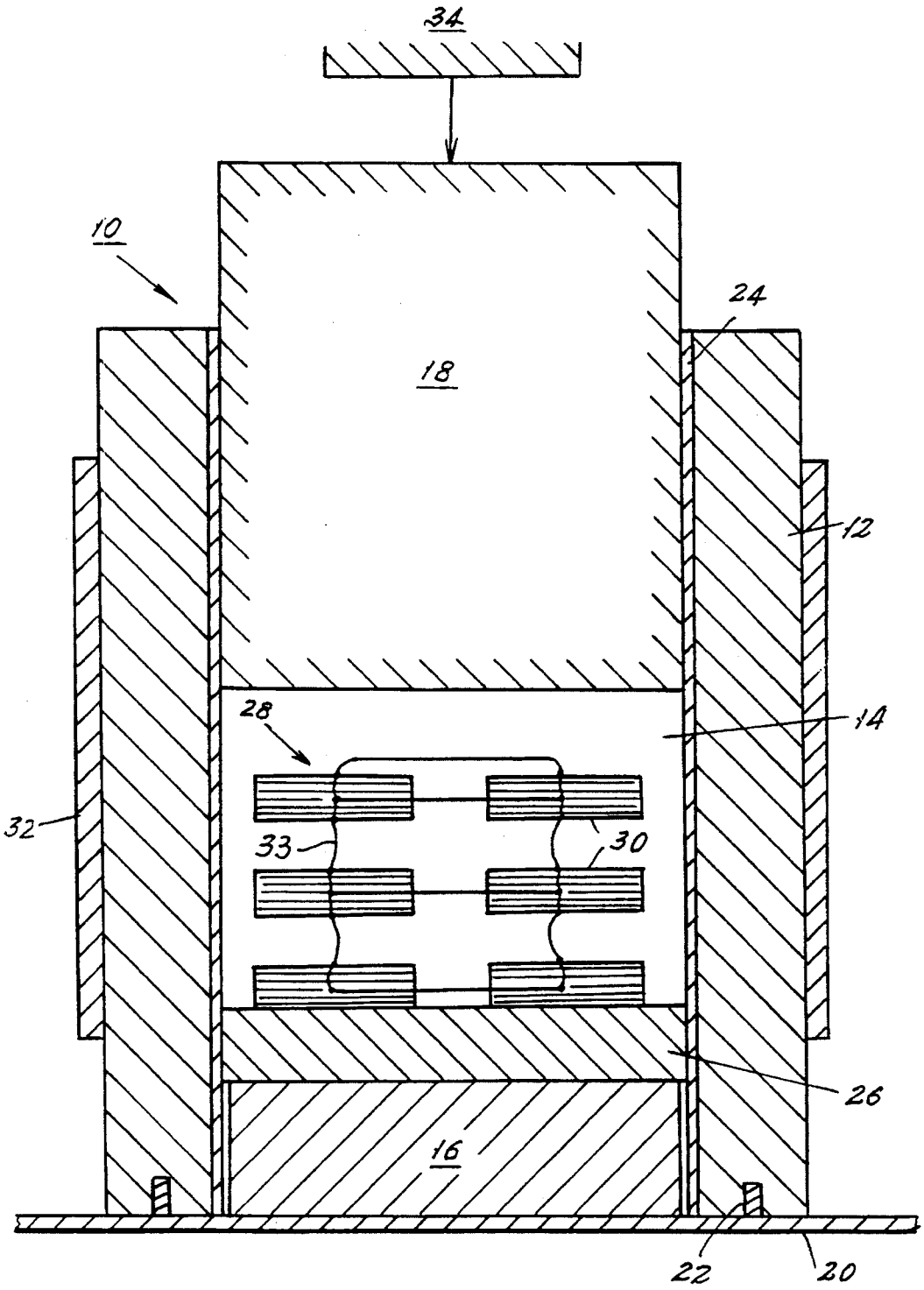
FIG. 1 is a cross-section of the mold assembly of the present invention.

Referring to FIG. 1, the alumina tile reinforced aluminum armor is prepared in a mold assembly 10. Mold assembly 10 includes a hollow steel die 12 with an inner cavity 14, a graphite plug 16 and a movable punch 18. Die 12 is mounted on a base plate 20 and is secured to base plate 20 by screws 22. Although screws are shown for removably connecting die 12 to base plate 20, any appropriate means for connection can be used. The inner surface of die 12 is preferably provided with a replaceable steel liner 24.

Graphite plug 16 is disposed on base plate 20 within die cavity 14. A silver coated 6061 aluminum disc 26, preferably made by the method disclosed in U.S. Pat. No. 4,958,763, is inserted within die cavity 14 and placed over the graphite plug 16. Disc 26 facilitates loading of an alumina tile preform 28 and also forms an integral part of a composite billet 38 (FIG. 2) after solidification, both of which are discussed in further detail below.

The tile preform 28 is prepared by weaving a plurality of cut alumina tiles 30 with a stiff steel wire 32 to form the configuration shown in FIG. 1, in which the thickness of the tiles (i.e. the dimension of the tile into the drawing, not shown in FIG. 1) is small compared to the height and width of the tiles.

The process of forming the composite armor will now be described. Liner 24, plug 16, and punch 18 are coated with a layer of colloidal graphite prior to use. The tile preform 28 is loaded into the mold assembly such that it rests on disc 26 in cavity 14. The mold assembly is heated, preferably to a temperature between 540° C. and 560° C., by a resistance ring heater 32. Punch 18 is heated separately in a muffle furnace to a temperature of about 570° C. Other conventional types of heaters can obviously be used to heat the mold assembly and punch 18.

To prepare the melt of molten aluminum, a predetermined quantity of 6061 aluminum (preferably about 5% more than is necessary, when melted, to fill cavity 14 to the appropriate level to form composite billet 38, taking into account the volume of the cavity and the volume of the preform) is placed in a crucible and heated in a muffle furnace under an atmosphere of argon to 770° C. Argon is used to minimize oxidation. Upon reaching the designated temperature, the crucible is removed from the furnace. The melt is skimmed and the molten metal is poured into cavity 14 of mold assembly 10, such that it completely covers preform 28 and disc 26.

Immediately after the molten metal has been poured into cavity 14, the heated punch 18 is inserted into the mold and driven downward with an electro-hydraulic press 34 to apply pressure to the molten metal surrounding preform 28. A full pressure of 2800 psi is preferably achieved about 10 seconds after the molten metal has been poured to guarantee full consolidation of the billet.

When the mold temperature drops below the solidus of the aluminum, typically about two minutes after the molten metal has been added, the pressure is released and punch 18 is retracted. Following the retraction of punch 18, the base plate 20 is removed and the composite billet 38 is pressed out of the mold assembly and allowed to air cool.

Figure 2:
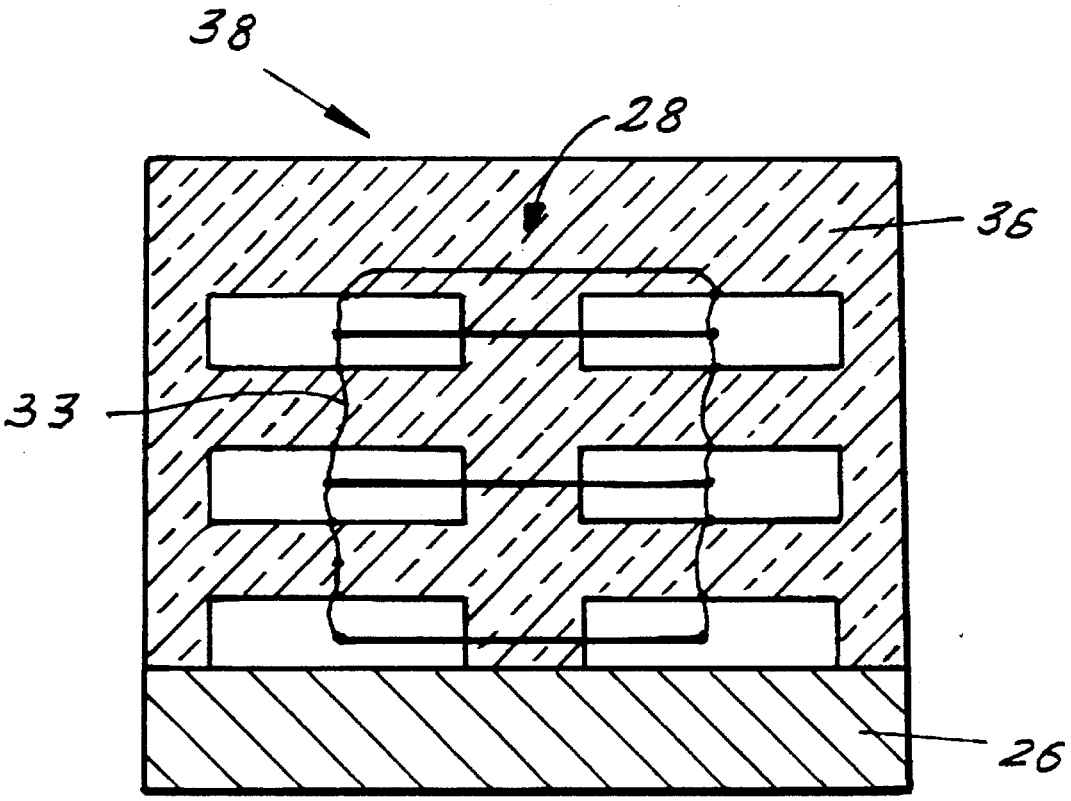
FIG. 2 is a cross-section of the composite armor after molding.

As shown in FIG. 2, the resulting composite billet of tile reinforced armor consists of aluminum disc 16 and preform 28, the preform being encased in solidified aluminum 36. Thus, in accordance with the present invention, an alumina tile reinforced aluminum alloy billet can be manufactured directly by a relatively simple procedure, in contrast to the former cut, set and weld method.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process of forming a billet of pressure cast, tile reinforced metal armor, comprising the steps of:

inserting a disc into a mold assembly, the mold assembly including a base plate, a die with an inner cavity disposed on the base plate, a plug disposed on the base plate within the die cavity, and a punch movably disposed within the die cavity, the disc being inserted in the mold assembly over the plug;

inserting a tile preform over the disc in the mold assembly;

heating the mold assembly and the tile preform contained therein to a first predetermined temperature;

heating the punch to a second predetermined temperature;

introducing a sufficient quantity of molten metal into the mold assembly to cover the tile preform;

immediately driving the heated punch into the die cavity to apply pressure to the molten metal;

allowing the molten metal to cool below the solidus temperature of the metal to form a billet of tile reinforced metal armor within the mold assembly; and removing the billet from the mold assembly.

2. The process of claim 1, wherein the tile preform is prepared by weaving a plurality of alumina tiles together with a steel wire.

3. The process of claim 1, wherein the first predetermined temperature is between 540° C. and 560° C.

4. The process of claim 1, wherein the second predetermined temperature is 570° C.

5. The process of claim 1, wherein the molten metal is prepared by heating a predetermined quantity of aluminum to a temperature of 770° C. under an atmosphere of argon.

6. The process of claim 1, wherein the pressure applied to the molten metal by the punch is increased to a full pressure of 2800 psi within ten seconds after introducing molten metal into the mold assembly.

7. The process of claim 1, wherein the die is provided with an inner metal liner.

8. The process of claim 7, further comprising an initial step of coating the liner, the punch and the plug with a layer of colloidal graphite.

9. A process of forming a billet of pressure cast alumina tile reinforced aluminum alloy armor, comprising the steps of:

inserting a silver coated 6061 aluminum disc into a mold assembly, the mold assembly including a base plate, a steel die with an inner cavity disposed on the base plate, a graphite plug disposed on the base plate in the die cavity, and a graphite punch movably disposed within the die cavity, the silver coated aluminum disc being inserted within the die cavity over the plug;

preparing an alumina tile preform by cutting a plurality of alumina tiles and weaving the tiles together with a stiff steel wire;

inserting the alumina tile preform into the mold assembly until the preform rests on the silver coated aluminum disc;

heating the steel die, the plug and the disc with a resistance ring heater to a temperature of between 540° C. to 560° C.;

heating the punch to a temperature of about 570° C.;

preparing a melt of molten aluminum by heating a predetermined quantity of aluminum in a muffle furnace to a temperature of 770° C. under an atmosphere of argon, and skimming the melt;

pouring the molten aluminum into the die cavity of the mold assembly, such that the tile preform is covered with molten metal;

immediately driving the heated punch into the die cavity with an electro-hydraulic press to apply pressure to the molten aluminum, and increasing the pressure to a full pressure of 2800 psi within ten seconds after pouring the molten aluminum into the die cavity of the mold assembly;

allowing the molten aluminum to cool below the solidus temperature of the aluminum to form a billet of pressure cast alumina tile reinforced aluminum alloy armor; and removing the billet from the mold assembly.

* * * * *